US007336149B2

(12) United States Patent
Ullermann

(10) Patent No.: US 7,336,149 B2
(45) Date of Patent: Feb. 26, 2008

(54) CIRCUIT BREAKER HAVING A BIMETALLIC SNAP-ACTION DISK

(75) Inventor: Wolfgang Ullermann, Schwabach (DE)

(73) Assignee: Ellenberger & Poensgen GmbH, Altdorf (DE)

( * ) Notice: Subject to any disclaimer, the term of this patent is extended or adjusted under 35 U.S.C. 154(b) by 0 days.

(21) Appl. No.: 11/408,365

(22) Filed: Apr. 21, 2006

(65) Prior Publication Data

US 2006/0186984 A1 Aug. 24, 2006

Related U.S. Application Data

(63) Continuation of application No. PCT/EP2004/011813, filed on Oct. 19, 2004.

(30) Foreign Application Priority Data

Oct. 21, 2003 (DE) ..... 103 48 864

(51) Int. Cl.
*H01H 37/52* (2006.01)
*H01H 37/54* (2006.01)

(52) U.S. Cl. ..... 337/66; 337/85; 337/89; 337/79

(58) Field of Classification Search ..... 337/14, 337/16, 27, 36, 53, 66, 85, 89, 79
See application file for complete search history.

(56) References Cited

U.S. PATENT DOCUMENTS 3,311,725 A * 3/1967 Butler et al. ..... 337/343
4,342,979 A * 8/1982 Phillips ..... 337/41
4,573,031 A 2/1986 Krasser
4,630,020 A 12/1986 Yang
4,633,240 A 12/1986 Guim et al.
4,833,439 A * 5/1989 Bowden et al. ..... 337/68
5,513,063 A * 4/1996 Wu ..... 361/105
5,918,361 A * 7/1999 Moalem et al. ..... 29/622
6,563,414 B2 * 5/2003 Yu ..... 337/66
2002/0149464 A1 10/2002 Santa Cruz et al.

FOREIGN PATENT DOCUMENTS

DE 35 26 785 C1 7/1986
DE 93 13 277.8 10/1993
GB 1 281 695 7/1972

* cited by examiner

*Primary Examiner*—Anatoly Vortman
(74) *Attorney, Agent, or Firm*—LAurence A. Greenberg; Werner H. Stemer; Ralph E. Locher

(57) ABSTRACT

A circuit breaker includes a bimetallic snap-action disk fixed to a bimetallic connection disposed in the vicinity of a fixed contact connection inside a coverable housing. The bimetallic disk has a contact end with a contact superposed with a fixed contact of the fixed contact connection in such a way that a contact is established. When the contacts are opened, a spring-loaded isolating slide moves between the contacts. The isolating slide has an illuminated push button for reliably identifying a disconnection.

7 Claims, 4 Drawing Sheets

CIRCUIT BREAKER HAVING A BIMETALLIC SNAP-ACTION DISK

CROSS-REFERENCE TO RELATED APPLICATIONS

This is a continuing application, under 35 U.S.C. §120, of copending International Application No. PCT/EP2004/011813, filed Oct. 19, 2004, which designated the United States; this application also claims the priority, under 35 U.S.C. §119, of German Patent Application 103 48 864.2, filed Oct. 21, 2003; the prior applications are herewith incorporated by reference in their entirety.

BACKGROUND OF THE INVENTION

Field of the Invention

The invention relates to a circuit breaker having a bimetallic snap-action disk fixed to a bimetallic connection disposed within a housing adjacent a fixed contact connection. The bimetallic disk has a contact end with a bimetallic contact which is in a contact-making, overlapping position with a fixed contact of the fixed contact connection. In the event of the contacts opening, a spring-loaded isolating slide moves between the contacts. The isolating slide has an illuminated pushbutton.

Such a circuit breaker, which is known from German Utility Model DE 298 24 696 U1, corresponding to U.S. Pat. No. 6,590,489, has a bimetallic snap-action disk, which is fixed to a bimetallic connection. The bimetallic connection is disposed within a housing base adjacent a fixed contact connection. The housing base can be covered through the use of a cap that is made, for example, of plastic or metal. The bimetallic snap-action disk carries a bimetallic contact which, within the housing, is in a contact-making, overlapping position with a fixed contact of the fixed contact connection.

In the event, for example, of an overcurrent causing the contacts to open due to the bimetallic snap-action disk being snapped up or bent up, an isolating slide, which is spring-loaded through the use of a spring element, moves between the contacts. As a result, the bimetallic snap-action disk is prevented from snapping back into the contact-making, closed position even once the bimetallic snap-action disk has cooled down. In that case, a circuit, into which the circuit breaker has been inserted as a fuse element, remains interrupted.

Such a circuit breaker is used in particular as a fuse element in circuits in a motor vehicle and, for that purpose, is inserted into corresponding flat fuse bases of the motor vehicle. Further application areas for such circuit breakers having a bimetallic snap-action disk are possible in domestic electrical appliances or the like.

In a prior art circuit breaker disclosed in U.S. Pat. No. 4,573,031, an isolating slide is connected in one piece with a pushbutton protruding from a housing. The isolating slide which is moved between the contacts in the event of tripping, can be manually brought into its starting position through the use of the pushbutton.

In a prior art circuit breaker disclosed in U.S. Patent Application Publication No. US 2002/0149464, an additional luminous element for optically indicating a tripping event is disposed within a pushbutton housing and protrudes therefrom. In accordance with U.S. Pat. No. 4,630,020, such a luminous element can also be entirely disposed within a pushbutton that is constructed in a hollow manner or spaced apart from the isolating slide within the housing in the region of an opening of the housing provided with a transparent covering.

SUMMARY OF THE INVENTION

It is accordingly an object of the invention to provide a circuit breaker having a bimetallic snap-action disk, which overcomes the hereinafore-mentioned disadvantages of the heretofore-known devices of this general type and which has been improved in terms of its tripping identification.

With the foregoing and other objects in view there is provided, in accordance with the invention, a circuit breaker. The circuit breaker comprises a housing, a fixed contact connection being disposed in the housing and having a fixed contact, and a bimetallic connection disposed in the housing adjacent the fixed contact connection. A bimetallic snap-action disk is fixed to the bimetallic connection and has a contact end with a bimetallic contact in a contact-making, overlapping position with the fixed contact of the fixed contact connection. A spring-loaded isolating slide moves between the fixed contact and the bimetallic contact upon the fixed contact and the bimetallic contact opening. The isolating slide has an illuminated pushbutton formed of a transparent material and has a material cutout formed therein. An electrical luminous element for illuminating the pushbutton is fixed in position inside the housing in the vicinity of the material cutout.

As a result of the illuminated pushbutton being connected within the housing to the isolating element, on one hand tripping of the circuit breaker is displayed visually in the form of a light signal that is visible from the outside. In addition, on the other hand, as a result of the coupling between the illuminated pushbutton and the isolating element, which is displaced between the contacts in the event of tripping, it is also possible for the pushbutton position, which protrudes further out of the switch housing, in comparison with a normal, fault-free position, by the displacement path of the isolating element, to be detected mechanically or manually from the outside. In addition, the actuation of the pushbutton is used to guide the isolating element back out of the contact isolating position, so that the contacts reach the contact position due to the spring force of the bimetallic snap-action disk.

The pushbutton is mechanically coupled to the isolating element which is in the form of a slide, within the housing, i.e. within the housing base in the case of a housing base that can be covered through the use of a housing cap. A latching or snap-action connection is provided for this purpose. In this case, the pushbutton expediently has at least one and preferably two latching arms having end-side latching cams, which engage in corresponding cutouts in the isolating element for the purpose of producing the latching or snap-action connection. It is also possible for the latching cams to be provided on the isolating element and for the latching cutouts to be provided on the pushbutton.

In order to illuminate the pushbutton, an electrical luminous element, for example a lamp or a light-emitting diode, is provided. The luminous element is disposed in such a way that it is fixed in position in the housing or housing base. In this case, the luminous element can be connected within the housing between the bimetallic connection and the fixed contact connection. With this wiring embodiment, the luminous element has current flowing through it when the bimetallic snap-action disk has been tripped, so that in the OFF state, i.e. when the circuit breaker has been tripped, the pushbutton is illuminated.

In accordance with an alternative wiring embodiment, contact is made between a first connection of the luminous element and the bimetallic connection within the housing, while a second connection of the luminous element is passed out of the housing base. In this embodiment, in which the luminous element connection which is passed to the outside is connected, for example, to a neutral conductor of a power supply system, in the normal state, i.e. in the contact-making, overlapping position of the contacts and with corresponding external wiring of the circuit breaker, the luminous element has current flowing through it, so that the pushbutton illuminates in the ON state and fails to be illuminated in the event of the contacts opening (OFF state).

The luminous element is disposed within the housing or housing base in the region of a material cutout in the pushbutton. Due to this material cutout, a pushbutton shaft and a pushbutton section, which protrudes beyond the pushbutton shaft and always at least partially protrudes beyond the luminous element even when the contacts are opened, is formed along the pushbutton. In this case, the shaft length is matched to the displacement path of the isolating element which is coupled to the pushbutton, with the result that the pushbutton, with its pushbutton shaft, can move or can be displaced in a contactless manner along the stationary luminous element. In this case, a gap formed between the pushbutton section and the luminous element is increased in the event of tripping by the displacement path of the isolating element or the pushbutton coupled to the isolating element.

The pushbutton and the isolating element, which moves between the contacts in the event of tripping, form a two-part isolating slide in the latched coupling state, in which case different materials are expediently used for the two parts of this isolating slide. The isolating element which, in the installed state, bears against the bimetallic contact and/or against the fixed contact, is thus on one hand made from a very thermally resistant plastic, i.e. a plastic which is resistant to thermal deformation, and expediently from a thermosetting plastic. On the other hand, the pushbutton is made from a transparent material, preferably from a transparent plastic. This ensures that the light emitted from the luminous element passes to the outside through the pushbutton shaft and/or the pushbutton section, which protrudes beyond the pushbutton shaft of the pushbutton.

In order to achieve a degree of prefabrication which is as high as possible and using as few individual parts as possible, the fixed contact connection and the bimetallic connection are in the form of identical flat contacts. In their central region, these contacts are bent out in the manner of a trough. The trough thus formed is then either used for fixing the bimetallic snap-action disk or for accommodating the fixed contact. For this purpose, the two identical flat contacts are inserted into the housing base, rotated through 180° with respect to one another, in relation to their longitudinal axis, and are fixed there expediently through the use of connecting rivets. When using tubular or hollow rivets, they take on the further function of receiving the connections or the individual connection of the luminous element in a contact-making manner.

The advantages achieved by the invention reside in particular in the fact that illumination which is integrated in a pushbutton of an isolating slide, that can be actuated from the outside by the pushbutton, of a circuit breaker having a bimetallic snap-action disk, makes it possible to achieve reliable tripping identification in a simple manner. The pushbutton thus takes on a dual function which is, on one hand, for guiding the isolating element back out of the contact isolating position when the pushbutton is actuated and, on the other hand, for optical signaling of an instance of the circuit breaker tripping as a result, for example, of an overcurrent.

Other features which are considered as characteristic for the invention are set forth in the claims which are appended below.

Although the invention is illustrated and described herein as embodied in a circuit breaker having a bimetallic snap-action disk, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
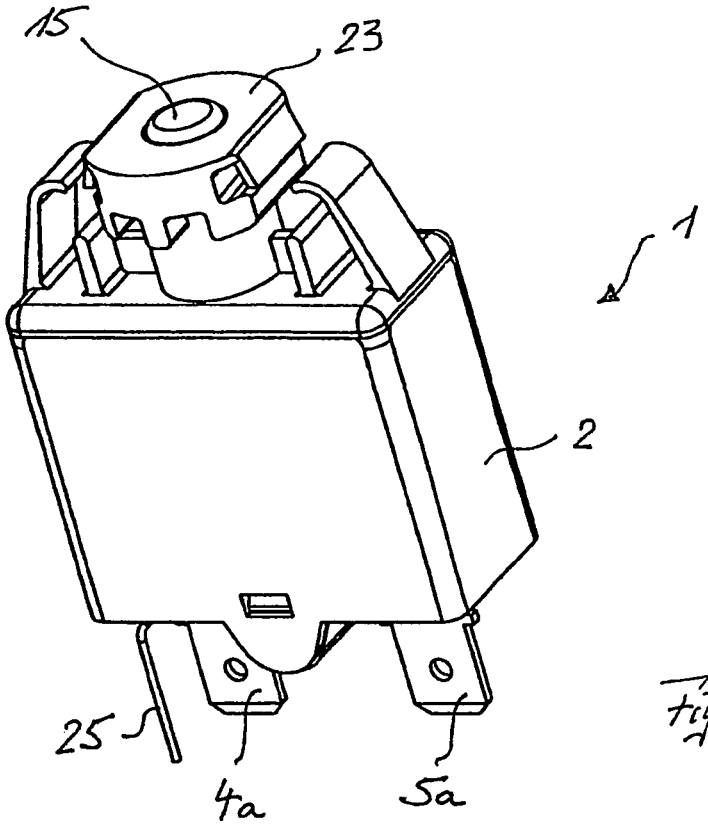
FIGS. 1 and 2 are diagrammatic, perspective views of a circuit breaker having a bimetallic snap-action disk and illuminated pushbutton, in which a housing base is covered FIG. 1 and uncovered in FIG. 2.
Figure 2:
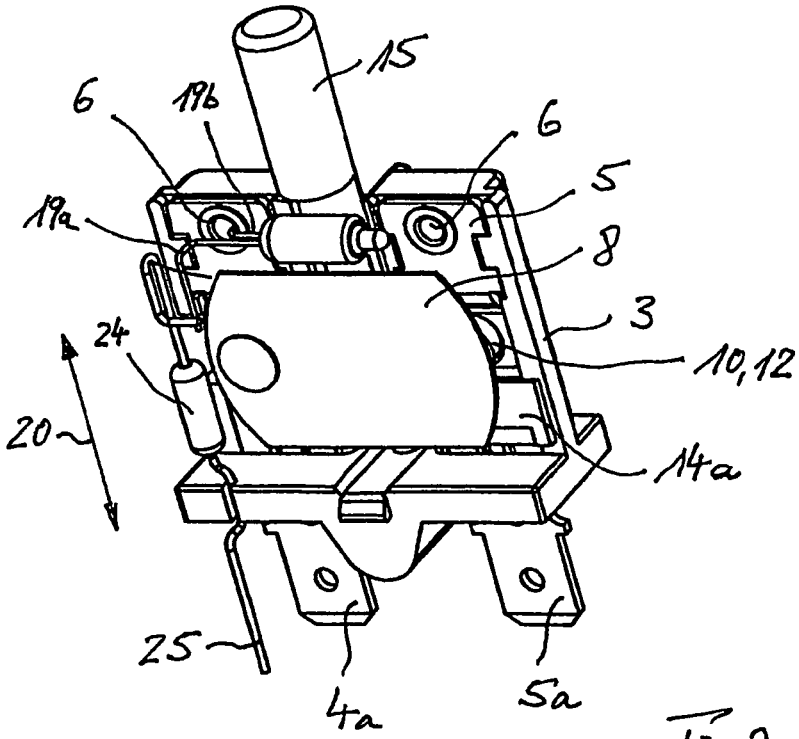
Figure 3:
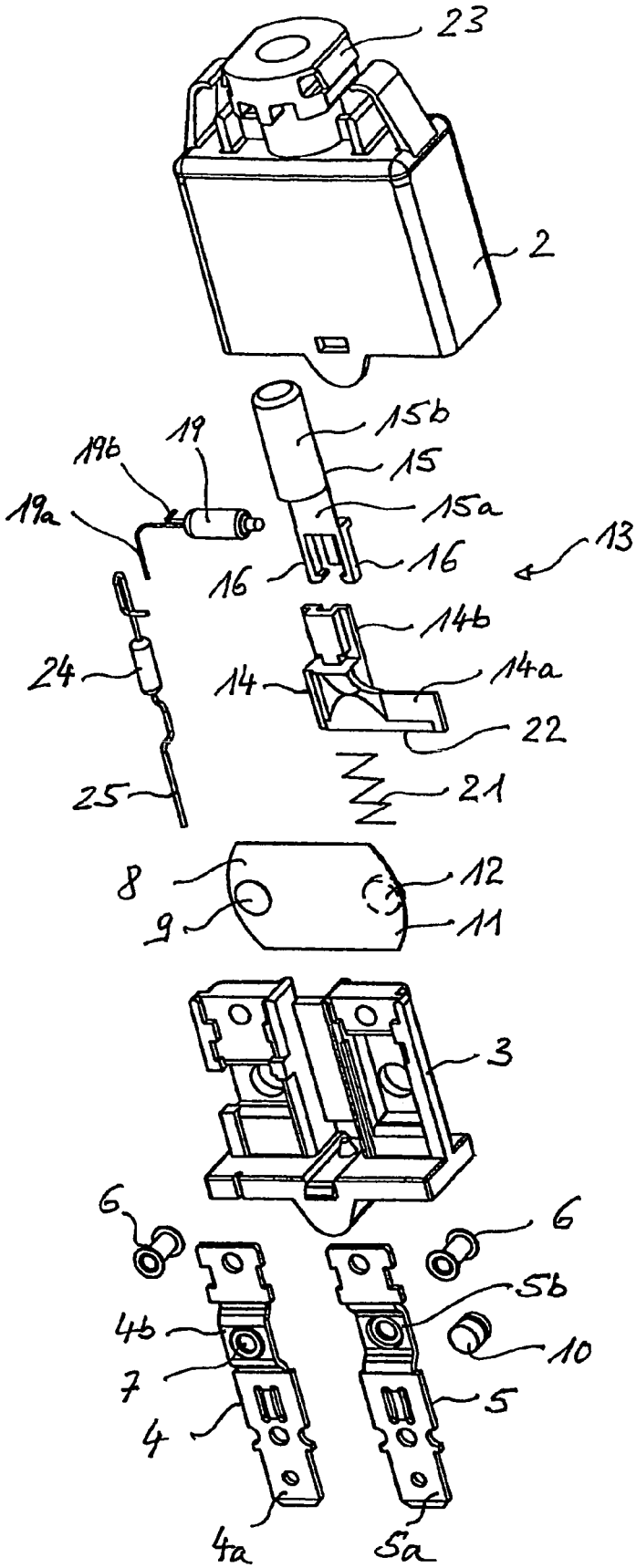
FIG. 3 is an exploded, perspective view of the circuit breaker shown in FIG. 1, with an isolating slide decoupled in the pushbutton and an isolating element.

Referring now in detail to the figures of the drawings, in which mutually corresponding parts are provided with the same reference numerals, and first, particularly, to FIGS. 1 to 3 thereof, there is seen a circuit breaker 1 that includes a housing base 3, which can be covered by a housing cap 2 and in which a bimetallic connection 4 and a fixed contact connection 5 are disposed parallel and adjacent one another. The connections 4 and 5, which are passed out of the housing base 3 on a connection side with respective connections ends 4*a* and 5*a* thereof, are fixed within the housing base 3 through the use of hollow rivets 6.

As can be seen in FIG. 3, the connections 4 and 5 are in the form of identical flat contacts and are bent back so as to form a trough 4*b*, 5*b*. The connections 4*b*, 5*b* are provided with openings 7 in respective trough apexes. In an installed state, the opening 7 in the bimetallic connection 4 is used for fixing a bimetallic snap-action disk 8 through the use of a rivet 9, and the opening 7 in the fixed contact connection 5 is used for accommodating a fixed contact 10. The bimetallic snap-action disk 8 carries a bimetallic contact 12 at a contact end 11 thereof facing away from the bimetallic connection 4. In the installed state, this bimetallic contact 12 is in a contact-making, overlapping position with the fixed contact 10, as is seen in FIG. 2.

Figure 5:
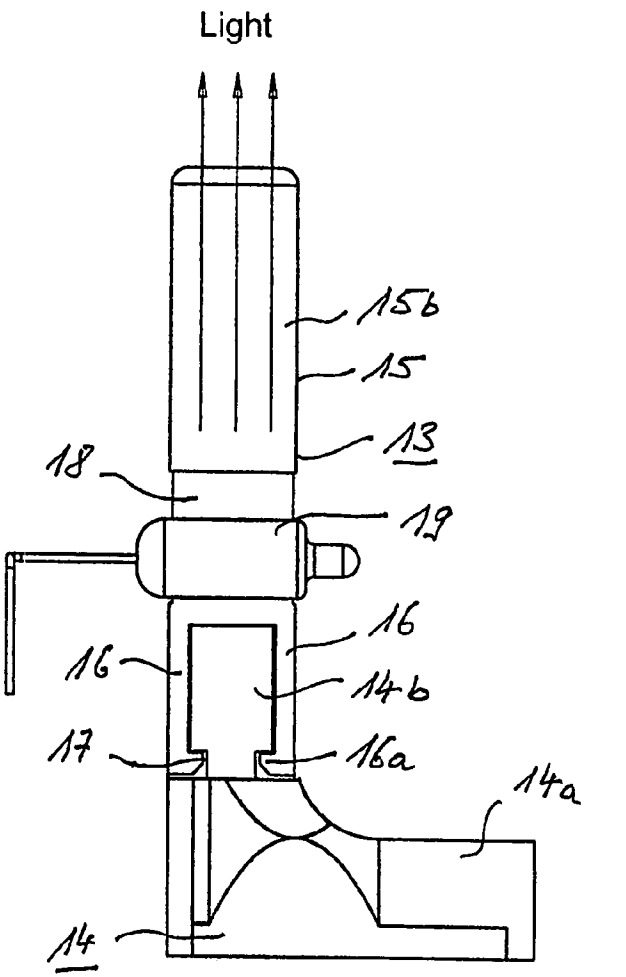
FIGS. 4 and 5 are respective enlarged, side-elevational and front-elevational views of the isolating slide.

A two-part isolating slide 13, which is expediently made from plastic, is disposed between the bimetallic connection 4 and the fixed contact connection 5 within the housing base 3. The two-part isolating slide 13 includes an L-shaped isolating element 14 and a pushbutton 15, which is mechanically coupled to the isolating element 14. A latching or snap-action connection provided for this purpose is formed by two latching arms 16 which, in the exemplary embodiment, are provided on the pushbutton 15 and carry mutually facing cams 16*a* on a free-end side. The pushbutton 15 is snapped onto the isolating element 14 through the use of the latching arms 16, in which case the latching cams 16*a* engage in corresponding latching cutouts 17 in the isolating element 14. This can be seen relatively clearly in FIG. 5.

Figure 4:
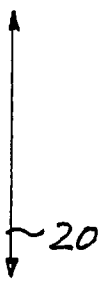
Figure 4:
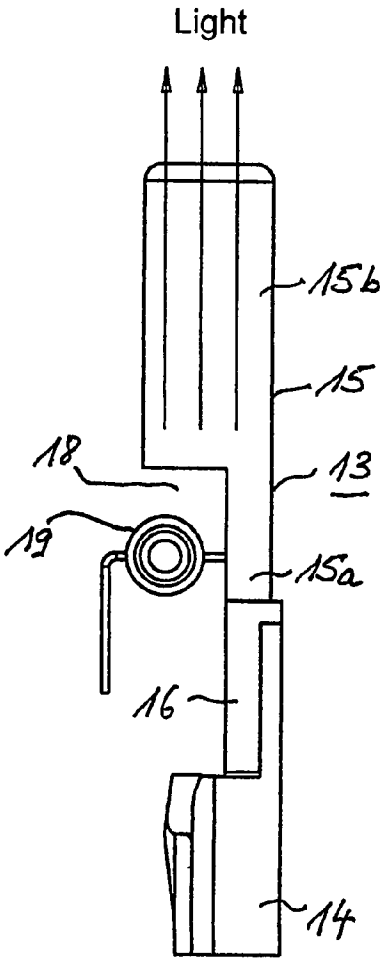

As is shown in the side view of the isolating slide 13 in FIG. 4, the pushbutton 15 has a material cutout 18 so as to form a pushbutton shaft 15*a* and a pushbutton section 15*b* which protrudes beyond the pushbutton shaft 15*a*. In the final mounted state, a luminous element 19, for example a lamp or a light-emitting diode, is positioned in the material cutout 18. The pushbutton 15 is made from a transparent material, preferably from a transparent plastic.

The luminous element 19 is at least partially overlapped by the pushbutton section 15*b* of the pushbutton 15 in each displacement position, extending in the direction of an arrow 20 in FIG. 4, of the isolating slide 13. Therefore, in any position of the isolating slide 13, the light emitted by the luminous element 19 passes to the outside, i.e. to outside the switch housing 2, 3, through the pushbutton shaft 15*a* and/or the pushbutton section 15*b* of the pushbutton 15.

The isolating slide 13 has the function of moving between the fixed contact 10 and the contact end 11 in the event of the circuit breaker 1 having been tripped, for example, due to an overcurrent. As a result, the contact end 11 with the bimetallic contact 12 moves away from the fixed contact 10 due to the bimetallic snap-action disk 8 opening or bending up. For this purpose, the isolating slide 13 is spring-loaded with a spring element 21. In this case, one side of the spring element 21 is supported on an underside 22 of the isolating element 14. The underside 22 is remote from the pushbutton 15. The other side of the spring element 21 is supported on the housing base 3. The electrically insulating isolating function is taken over by an isolating limb 14*a* of the isolating element 14. The isolating limb 14*a* extends transversely with respect to the shaft extent of the pushbutton 15 and merges at right angles with a shaft 14*b* of the isolating element 14 which has the latching cutouts 17.

The isolating element 14 itself is made from a temperature-resistant plastic material or a plastic material which is resistant to thermal deformation, preferably from a thermosetting plastic. The reason for this is the fact that the isolating element 14 is always at least approximately in touching contact with the contacts 10, 12 which carry current during operation.

In the tripping-free ON state of the circuit breaker 1 illustrated in FIG. 2, the isolating limb 14*a* of the isolating element 14 bears against the contacts 10, 12 on the underside, remote from the pushbutton 15, of the contacts 10, 12. In the event of tripping, in the case of which the bimetallic contact 12 is lifted off of the fixed contact 10 as a result of the bimetallic snap-action disk 8 bending up or snapping up, the isolating slide 13 is displaced in the displacement direction 20 as a result of the spring force brought about by the spring element 21 and is guided precisely between the two contacts 10, 12 while forming an abutment or stop within the housing base 3. As a result, the two contacts 10, 12 are mechanically spaced apart from one another and electrically insulated from one another.

As a result of this pushing movement of the isolating slide 13, the pushbutton 15 is displaced by the same displacement path in the displacement direction 20 due to the fact that it is coupled with the isolating element 14, and in the process is guided over the housing cap 2 towards the outside of the switch housing 2, 3 through this displacement path. In this final tripping position of the isolating slide 13, the pushbutton 15 protrudes beyond a dome-like pushbutton sleeve 23 placed onto the housing cap 2. This pushbutton sleeve 23 may be an integral component or part of the housing cap 2 or may be snapped onto it as a separate part.

In the event of tripping, isolation of the contacts 10, 12, due to the isolating slide 13 being pushed between them, is maintained until the isolating element 14 is displaced in the opposite direction along the displacement direction 20 due to the pushbutton 15 being depressed. As a result of the spring force of the bimetallic snap-action disk 8 once it has cooled down, the bimetallic contact 12 is again pressed against the fixed contact 10. In this contact-making, overlapping position, the isolating slide 13 is held in its initial position in which it has been guided back and which corresponds to the ON state of the circuit breaker 1.

With regard to the wiring for the luminous element 19 which can be seen comparatively clearly in FIG. 2, a first connection 19*a* is passed out of the housing base 3 through an ohmic resistor 24 so as to form an external supply connection 25. The supply connection 25 in this case is expediently passed outward on the same housing side of the housing base 3, on which the connection ends 4*a*, 5*a* of the respective connections 4 and 5 also lie. A second connection 19*b* of the luminous element 19 is guided into the hollow rivet 6, which fixes the bimetallic connection 4 within the housing base 3, and makes electrical contact with the bimetallic connection 4 through the hollow rivet 6, for example by making plugging contact with the hollow rivet 6 or being soldered thereto.

Figure 6:
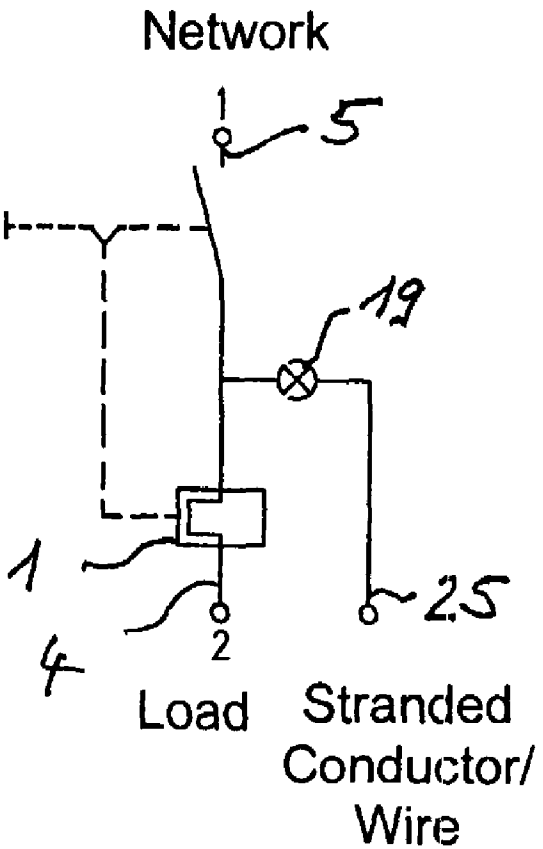

In accordance with a wiring embodiment illustrated in the form of a schematic diagram in FIG. 6, the luminous element connection 19*a*, which is passed to the outside, is connected, for example, to a neutral conductor of a power supply system, and the luminous element 19 has current flowing through it in the normal state, i.e. in the contact-making, overlapping position of the contacts. With corresponding external wiring, the pushbutton thus illuminates in the ON state and is not illuminated in the OFF state when the contacts 10, 12 are open.

Figure 7:
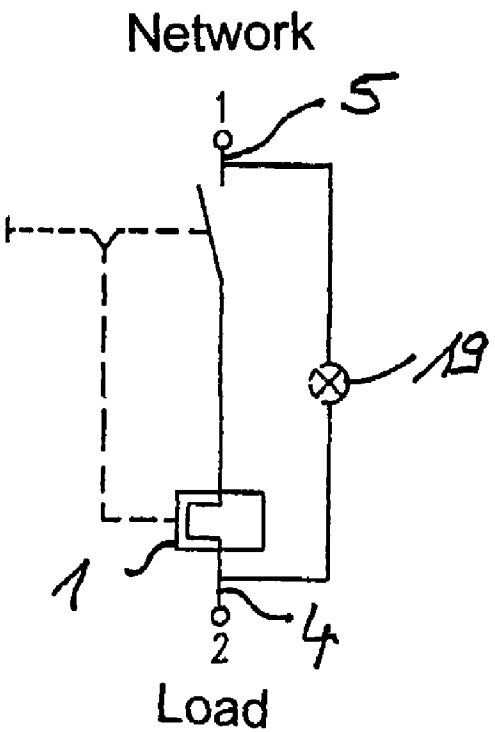
FIGS. 6 and 7 are schematic diagrams of two different circuit embodiments of a luminous element inserted into a housing base.

In accordance with a further wiring embodiment shown in FIG. 7, the luminous element 19 can also be wired exclusively within the housing in a non-illustrated manner. For this purpose, the connection 19*a* (of the luminous element 19) which is passed to the outside in accordance with the embodiment shown in FIGS. 2 and 6, is passed in an electrically contact-making manner into the hollow rivet 6, which fixes the fixed contact connection 5, in an analogous manner to the plugging contact-making of the connection 19*b*. In this case, the luminous element 19 can in turn be switched on by using a series circuit including the nonreactive resistor 24 and the luminous element 19 between the bimetallic connection 4 and the fixed contact connection 5. In this wiring embodiment, the luminous element 19 has current flowing through it when the bimetallic snap-action disk 8 has been tripped, with the result that the pushbutton 15 is illuminated in the OFF state and is not illuminated in the ON state.

In both wiring embodiments, but in particular with the wiring embodiment shown in FIGS. 2 and 6, instead of open wiring for the luminous element 19 and the resistor 24, the resistor 24 and the soldered joint formed between the resistor 24 and the connection 19*a* can be covered by non-illustrated shrink-down tubing. As a result, undesirable electrical contact-making is reliably avoided.

The circuit breaker 1 described herein having an illuminated pushbutton 15 is suitable for a large number of application areas, for example as motor, transformer or cable drum protection.

I claim:

1. A circuit breaker, comprising:

a housing;

a fixed contact connection being disposed in said housing and having a fixed contact;

a bimetallic connection disposed in said housing adjacent said fixed contact connection;

said fixed contact connection and said bimetallic connection being identically shaped flat contacts having a longitudinal axis and a central region bent out in a trough defining an outside of said trough and an inside of said trough;

a bimetallic snap-action disk fixed to said bimetallic connection and having a contact end with a bimetallic contact in a contact-making, overlapping position with said fixed contact of said fixed contact connection;

said flat contacts being inserted into said housing mutually rotated about said longitudinal axes, with said bimetallic snap-action disk fixed to said outside of said trough of said bimetallic connection and said fixed contact fixed to said inside of said trough of said fixed contact connection;

a spring-loaded isolating slide moving between said fixed contact and said bimetallic contact upon said fixed contact and said bimetallic contact opening, said isolating slide having an illuminated pushbutton formed of a transparent material and having a material cutout formed therein; and an electrical luminous element for illuminating said pushbutton, said luminous element being fixed in position inside said housing in vicinity of said material cutout.

2. The circuit breaker according to claim 1, wherein said material cutout defines a pushbutton shaft and a pushbutton section protruding beyond said pushbutton shaft and always protruding at least partially beyond said luminous element.

3. The circuit breaker according to claim 1, wherein said isolating slide has an isolating element connected to said pushbutton within said housing.

4. The circuit breaker according to claim 1, wherein said luminous element is connected within said housing between said bimetallic connection and said fixed contact connection.

5. The circuit breaker according to claim 1, wherein said luminous element has a first connection extended out of said housing and a second connection contacting said bimetallic connection within said housing.

6. The circuit breaker according to claim 3, wherein said isolating element is made of at least one material selected from the group consisting of a thermally resistant plastic and a plastic resistant to thermal deformation.

7. The circuit breaker according to claim 1, wherein said luminous element is disposed in said material cutout.

* * * * *